United States Patent [19]

de Cachard et al.

[11] 4,070,871

[45] Jan. 31, 1978

[54] METHOD OF COLD PRODUCTION AND DEVICES FOR THE PRACTICAL APPLICATION OF SAID METHOD

[75] Inventors: Maurice de Cachard, La Tronche; Robert Moracchioli, Seyssinet; Gérard Marie, Eybens, all of France

[73] Assignee: Commissariat a l'Energie Atomique, Paris, France

[21] Appl. No.: 618,576

[22] Filed: Oct. 1, 1975

[30] Foreign Application Priority Data

Oct. 8, 1974 France ..... 74 33849

[51] Int. Cl.[2] ..... F25B 1/02; F25B 1/04

[52] U.S. Cl. ..... 62/116; 60/651; 60/671; 62/117; 62/467 PR

[58] Field of Search ..... 62/116, 117, 467 PR, 62/500, 498; 60/651, 671; 417/391, 348, 349; 418/15

[56] References Cited

U.S. PATENT DOCUMENTS

| | | | |
|---|---|---|---|
| 2,844,945 | 7/1958 | Muffly | 418/15 |
| 2,991,632 | 7/1961 | Rogers | 62/498 |
| 3,196,631 | 7/1965 | Holland | 62/498 |

*Primary Examiner*—Ronald C. Capossela
*Attorney, Agent, or Firm*—Flynn & Frishauf

[57] ABSTRACT

A first mass of driving vapor is admitted into a single chamber of variable volume and permitted to perform isobaric then polytropic work in an expansion which increases the chamber volume. A second mass of vapor derived from the refrigeration cycle is then admitted at constant pressure in order to attain maximum volume. The work performed by the driving vapor is utilized in a polytropic process for compressing the vapor masses which are then discharged to the condenser in an isobaric process when the chamber approaches minimum volume.

8 Claims, 5 Drawing Figures

METHOD OF COLD PRODUCTION AND DEVICES FOR THE PRACTICAL APPLICATION OF SAID METHOD

This invention relates to a method of cold production and to an apparatus for carrying out said method.

The invention is of particular interest in the production of cold from heat which is lost or inefficiently utilized as is the case in the exhaust of heat engines and low-pressure steam engines.

The invention applies primarily to controlled-temperature transportation vehicles such as boats, trucks and the like and is also applicable in the food industry (dairies, biscuit factories and the like).

It is known that, in order to produce cold, a fluid such as Freon or ammonia can be subjected to a cycle which consists in evaporating said fluid within a first heat-exchanger or evaporator at a temperature $t_1$ and a pressure $p_1$. The vapor produced is then compressed to a pressure $p_2$ and a temperature $t_2$ which are higher than $p_1$ and $t_1$. A second heat exchanger condenses the steam and releases heat at the temperature $t_2$. Finally, an expansion valve causes a reduction in the pressure of the condensate from $p_2$ to $p_1$.

Moreover, it is also a known practice to improve the overall efficiency of heat engines by recovering heat either from the exhaust in the case of an internal combustion engine or through the condenser in the case of a steam engine. The heat recovered is employed in a thermomechanical converter device which can operate in accordance with the Rankine cycle with a fluid whose properties are identical with or similar to those of cold-producing fluids.

In the second system, the hot source exchanger performs the function of boiler and the cold source exchanger performs the function of condenser. The compressor and the expansion valve of the first device are replaced respectively by a steam engine which supplies the mechanical power and a feed pump which absorbs a fraction of this energy in the second system.

Finally, there are known methods and devices for cold production in which these two arrangements are combined insofar as the cold is produced from inadequately utilized heat by means of a motor-driven compressor which is supplied both with the cold-producing fluid and with the energy-producing fluid. In this known art, however, the compression chamber is separate from the driving chamber, the transmission of energy between the two chambers being carried out either by pistons or by crankshafts. This results in complexity of the machine and poor efficiency.

The invention relates to a method and a device of this type which overcome the disadvantages mentioned since they have recourse to a single chamber which serves both as a driving chamber and a compression chamber, the fluid being accordingly subjected within said chamber to an original cycle in which the two operations are interdependent. This results in enhanced efficiency and in simplification of the apparatus.

In more precise terms, the invention is directed to a method of cold production of the type in which:

in a driving cycle which makes use of a fluid, a heat source delivers to an exchanger the heat which is necessary for evaporation of said fluid, the vapor obtained performs driving work, then passes through a condenser and returns to said exchanger, in a refrigeration cycle which makes use of the same fluid, said fluid is evaporated within an evaporator which produces cooling, then undergoes compression and is discharged into the condenser of the driving cycle, then undergoes expansion before returning to said evaporator, the energy supplied by the vapor in the driving work of the driving cycle is employed for producing the compression of the steam in the refrigeration cycle, characterized in that the driving work and compression work are developed within a single chamber of variable volume provided with closable orifices.

In accordance with a first embodiment of said method:

a first mass of driving vapor is admitted into the single chamber of variable volume, said first mass is permitted to perform an isobaric then polytropic work in an expansion which increases the volume of said chamber, a second mass of vapor derived from the refrigeration cycle is then admitted at constant pressure in order to attain the maximum volume of said chamber, the driving work produced by the driving vapor is utilized for compressing the first and second masses in a polytropic process, said masses are discharged to the condenser in an isobaric process when said chamber approaches its minimum volume.

In order to apply this alternative embodiment in practice, it is an advantage to employ a chamber defined by a cylinder and a piston which is capable of moving between a top dead-center and a bottom dead-center and the operation is performed as follows:

the first mass of vapor is introduced into said cylinder by a first admission means when the piston is located at the top dead-center, said first mass is permitted to expand by closing said first admission means and by allowing the piston to move towards the bottom dead-center, said second mass of vapor is introduced by a second admission means before the piston reaches the bottom dead-center and until the piston reaches said bottom dead-center, said masses are compressed after closure of said admission means by causing the piston to return to the top dead-center, said masses are discharged by an exhaust means before the piston reaches the top dead-center, the exhaust means is closed when the piston has reached the top dead-center.

This alternative embodiment can also be carried into effect, however, by employing a sealed casing comprising a rotor fitted with vanes and by proceeding as follows:

said first mass of vapor is introduced through a first intake port into the space located between two consecutive vanes of said rotor, said first mass is allowed to expand and cause the rotation of said vanes which thus move clear of the first intake port, said second mass of vapor is introduced into said space through a second intake port and said masses are permitted to produce action on the blades in order to bring these latter into the final expansion zone after having passed beyond the second intake port, said masses are allowed to undergo compression under the action of rotational motion of the rotor vanes, said masses are discharged through an exhaust port.

The invention is also directed to a cold production apparatus for the practical application of the method hereinabove defined, said apparatus being of the type comprising:

a driving loop system constituted by a heat source associated with a heat exchanger at the temperature $T_1$ and a motor actuated by the vapor delivered by said heat exchanger and a refrigerating loop constituted by an evaporator at the temperature $T_2$, a compressor for the vapor delivered by said evaporator, a condenser which coincides with that of the driving loop and an expansion valve, the apparatus in accordance with the invention being characterized in that it comprises a motor-driven compressor set constituted by a single chamber of variable volume provided with closable orifices and intended to receive both the vapor derived from the driving loop and the vapor derived from the refrigerating loop.

In a first alternative embodiment, the motor-driven compressor is of the type comprising a cylinder and a piston actuated by a connecting-rod and crankshaft linkage, and comprises:

two admission means for successively introducing between the top and bottom dead-centers of said piston masses of vapor of the fluid supplied from said heat exchanger and from said evaporator, an exhaust means for discharging said masses to the condenser after compression by the piston which has moved back to the top dead-center.

In a second alternative embodiment, the motor-driven compressor is of the sealed-casing type provided with an eccentric rotor with radial vanes and comprises:

two intake ports in spaced relation for successively introducing into the space provided between two vanes masses of vapor of a fluid supplied from said heat exchanger and said evaporator, an exhaust port for discharging said masses to the condensor after compression within said space.

The description which now follows relates to examples of application which are not given in any limiting sense, reference being made to the accompanying drawings, in which.

Figure 1:
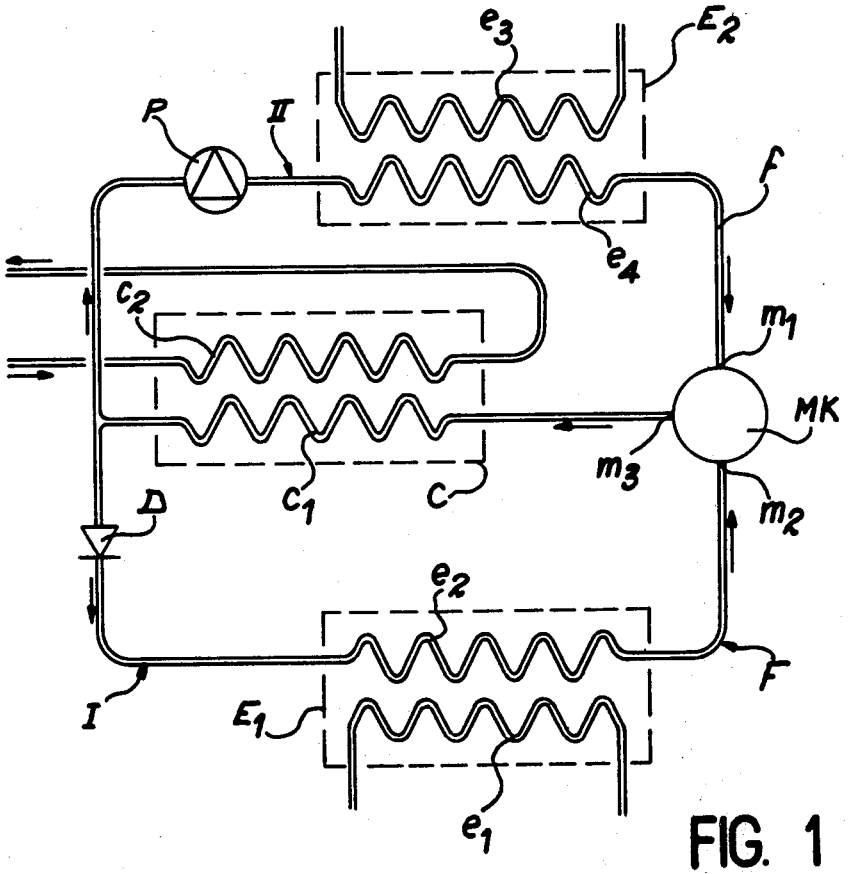
FIG. 1 is a general schematic diagram of cold production from recovered heat in accordance with the invention.

In FIG. 1, the reference $E_1$ designates the evaporator of a cold-production generator which comprises a primary circuit $e_1$ and a secondary circuit $e_2$. The primary circuit $e_1$ is connected to an installation such that a cold chamber and the secondary circuit $e_2$ together with an expansion valve D form the portion I of a common circuit F, the design function of which will be explained in greater detail hereinafter. A heat exchanger $E_2$ comprises a primary circuit $e_3$ connected to a so-called heat source installation such as, for example, a system for the recovery of heat lost by exhaust from a heat engine and a secondary circuit $e_4$ supplied by a pump P which forms the portion II of the common circuit F.

Figure 3:
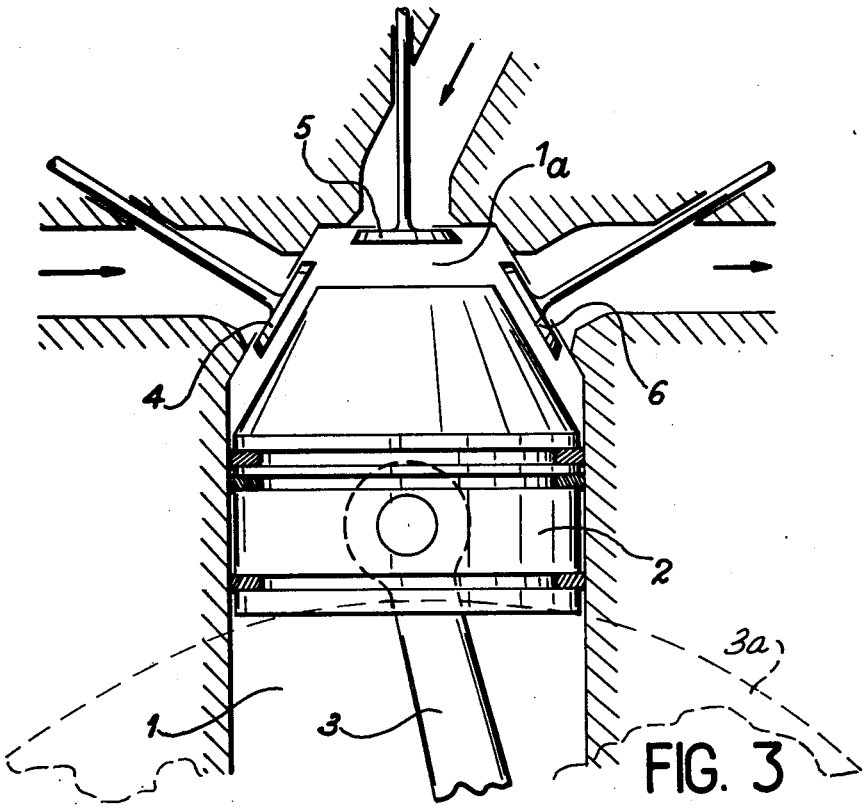
FIG. 3 is a diagrammatic view of one form of construction of a piston-type motor-driven compressor.
Figure 5:
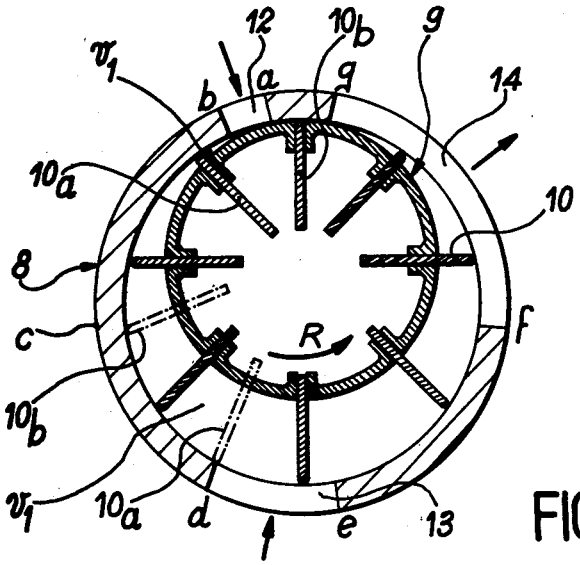
FIG. 5 is a diagrammatic view of another form of construction of a motor compressor with an eccentric rotor.

The primary circuit $c_1$ of a condenser C is common to the portions I and II of the circuit F as well as to a motor-driven compressor set MK in accordance with the invention as shown in detail in FIGS. 3 and 5. In the example under consideration, the secondary circuit $c_2$ is of the cold water circulation type.

The common circuit F is filled with a fluid *f* such as Freon, ammonia, butane and the like.

The secondary circuit $e_4$ (portion II) terminates in a high-pressure intake $m_1$ of a motor compressor MK. The secondary circuit $e_1$ terminates in a low-pressure intake $m_2$. The exhaust $m_2$ is connected to the inlet of the circuit $c_1$ (condenser C).

A circuit of this type is designed to permit recovery of the greater part of the heat lost by exhaust from a heat engine within the heat exchanger $E_2$ and by means of a mass $M_3$ of the fluid *f* which circulates within the circuit $e_4$ under the action of the pump P. By absorbing the heat transferred to the circuit $e_3$ (portion II), the mass $M_3$ of fluid *f* is vaporized and introduced at a high pressure $p_3$ (FIG. 2) into the driving portion of the motor compressor MK.

At the same time, heat is recovered from the heat exchanger $E_1$ by means of a mass $M_1$ of fluid F which circulates within the circuit $e_2$ under the action of the differences in pressure and temperature between the condenser C and the heat exchanger $E_1$. By absorbing the heat transferred to the circuit $e_2$ (portion I), the mass $M_1$ of fluid *f* is vaporized and introduced at low pressure $p_1$ (FIG. 2) into the compressor portion of the motor compressor MK after expansion of that fraction of high-pressure fluid which decreases from the pressure $p_3$ to $p_1$.

The entire quantity $M_1 + M_3$ of fluid F is then compressed from the pressure $p_1$ to an intermediate pressure $p_2$ within the compressor portion of the assembly MK and then discharged at the same pressure $p_2$ to the condenser C which is maintained at a mean temperature by the cooling circuit $c_1$.

At the outlet of the condenser C, the mass $M_3$ of fluid *f* is recirculated by the pump P so as to flow within the portion II of the circuit F whilst the other mass $M_1$ passes through the expansion valve D so as to flow within the portion I.

Figure 2:
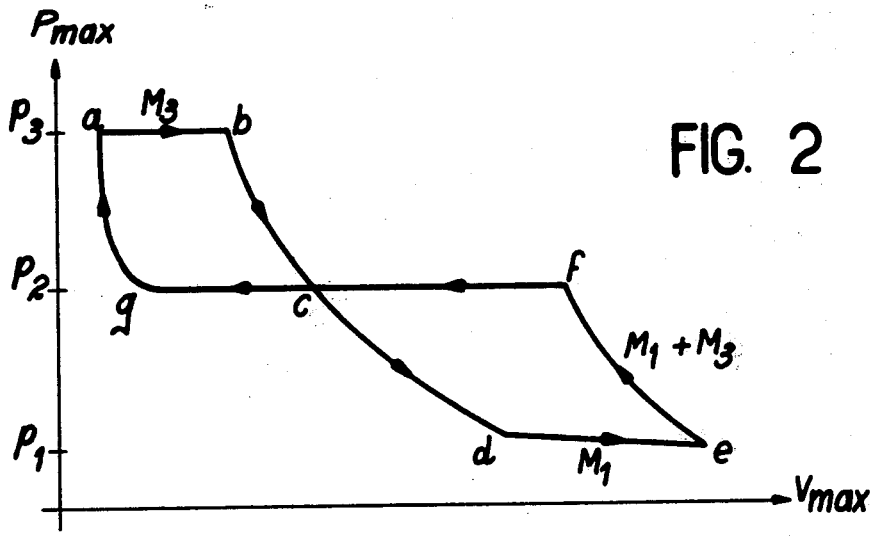
FIG. 2 is a pressure-volume diagram showing the path followed by the fluid during the cycle.

One embodiment of the invention which is represented by the motor compressor assembly of FIG. 3 makes it possible to follow the flow path of the fluid in accordance with the diagram of FIG. 2. The motor compressor is of the type comprising a cylinder 1 and a piston 2 actuated by a conventional linkage consisting of a connecting-rod 3 and crankshaft (not shown).

The head 1*a* of the cylinder 1 is fitted with three valves, namely two intake valves 4 and 5 and an exhaust valve 6 which correspond respectively to the references $m_1$, $m_2$ and $m_3$ of FIG. 1 and communicate in the same order with the heat source exchanger $E_2$, the evaporator $E_1$ and the condenser C.

The operation of the motor compressor of FIG. 3 is explained in connection with the diagram of FIG. 2 and the phases *a* to *q* of FIG. 4.

When the piston 2 is located at top dead-center and when the intake valve 4 is opened whilst the other valves 5 and 6 are closed, a mass of vapor $M_3$ of the fluid at high pressure $p_3$ produced by the heat source exchanger $E_2$ passes into the cylinder 1 and performs isobaric work on the piston 2 which moves from *a* to b. The valve 4 is closed and the mass $M_3$ expands so as to displace the piston 2 from *b* to *d*. As the travel of the piston continues, the intake valve 5 (the valves 4 and 6 being closed) and a mass $M_1$ of fluid vapor at low pressure $p_1$ produced by the cold source $E_1$ is admitted at constant pressure, with the result that the piston moves from *d* to *e*. The three valves 4, 5 and 6 are closed at *e*, which corresponds to bottom dead-center. From bottom dead-center, the piston 2 is displaced in the opposite direction by the inertia of the flywheel 3*a* which drives the connecting-rod and crankshaft linkage 3 and compresses the masses of vapor $M_3$, $M_1$ at intermediate pressure $p_2$ from *e* to *f*.

At *f*, the exhaust valve 6 is opened and the masses $M_3 + M_1$ are discharged to the condenser C at the delivery pressure $p_2$.

The three valves 4, 5 and 6 are closed in the vicinity of top dead-center so that there remains only a residual fraction of fluid from *g* to *a*.

A further mode of application of the invention is represented by the motor-driven sliding-vane rotary compressor of the sealed-casing type as shown in FIG. 5 which comprises a stator 8 and an eccentric rotor 9 fitted with vanes 10, two intake ports 12, 13 and a discharge port 14 which opens into the stator 8.

The ports correspond respectively to the references $m_1$, $m_2$ and $m_3$ of FIG. 1 and communicate in the same order with the heat source exchanger $E_2$, the evaporator $E_1$ and the condenser C.

Figure 4:
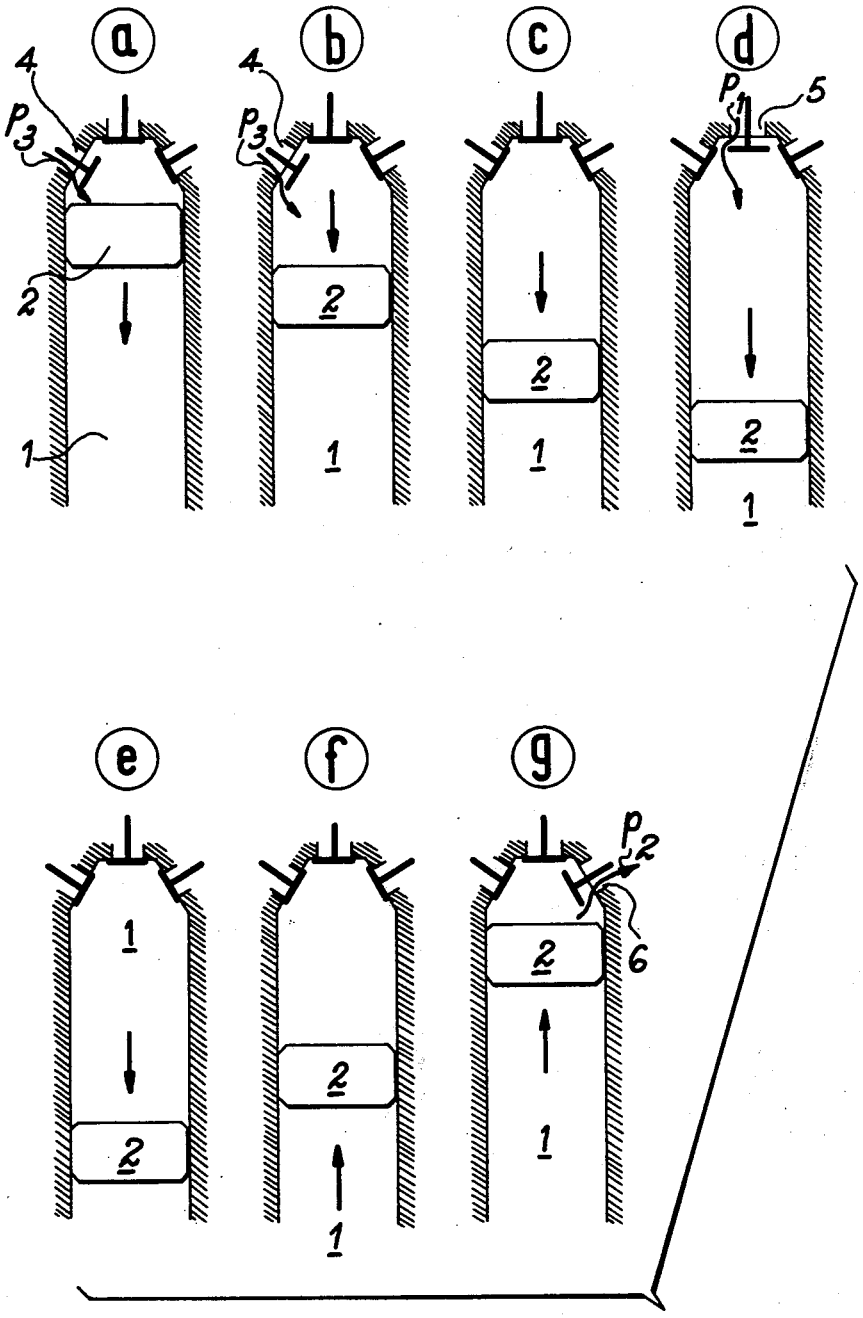
FIG. 4 shows the different phases of the motor compressor of FIG. 3.

The operation of the motor compressor of FIG. 5 is explained in relation to the diagram of FIG. 4. The direction of rotation of the rotor 9 is indicated by the arrow R.

It will further be noted that the lengths of arc of the ports 12, 13 and 14 correspond to the points *a* and *q* of the diagram of FIG. 2.

The admission of a mass of vapor $M_3$ at high pressure $p_3$ into the sealed casing takes place when the port 12 communicates with a volume $v_1$ defined by two successive vanes such as the vanes 10*a*, 10*b*, the stator 8 and the rotor 9.

Expansion of the mass $M_3$ initiates rotational displacement of the vane 10*a* to position *d* whilst other volumes $v_1$ are filled successively through the port 12 in the direction of rotation R of the rotor 9. Expansion of the mass $M_3$ takes place up to position *d* as a result of progressive variation of the volume $v_1$ by reason of the relative displacement between the stator 8 and the rotor 9.

As soon as a vane 10*a* passes beyond position *d*, the corresponding volume $v_1$ receives through the intake port 13 a mass of vapor $M_1$ at constant low pressure $p_1$ until the vane 10*b* passes beyond the point *e*. During the path corresponding to the arc *ef*, the masses $M_3 + M_1$ are compressed as a result of the reduction in volume $v_1$ and discharged through the port 14 as soon as the vane 10*a* passes beyond the point *f*.

The power cycle begins again as soon as the vane 10*a* passes beyond the point of origin *a* of the intake port 12.

We claim:

1. A method of refrigeration by means of: a condenser for liquefying a refrigerant, a vaporizer for vaporizing some of the liquefied refrigerant and thereby absorbing heat provided from a heat source for powering refrigeration cycle, an evaporator for evaporating some of the refrigerant and thereby refrigerating a space to be cooled, and a vapor-driven variable-volume machine having a variable-volume chamber, an energy-storing rotary member, a single outlet, and separate first and second inlets, comprising the steps of:

passing a portion of the liquid refrigerant output of said condenser to said evaporator;

vaporizing said portion of said liquid refrigerant in said vaporizer while absorbing heat in said refrigerant from a heat source provided for powering a refrigeration cycle;

concurrently with said vaporizing step, passing another portion of the liquefied refrigerant output of said condenser to said evaporator and evaporating said last-mentioned portion of said condenser output in said evaporator to provide cooling;

feeding the output vapor of said vaporizer to the said first inlet of said variable-volume machine and simultaneously feeding the output vapor of said evaporator to said second inlet of said variable-volume machine;

operating said variable-volume machine by the substeps of:

admitting to the variable-volume chamber of said machine, through said first inlet, a quantity of output vapor of said vaporizer and permitting it to perform first isobaric work and then polytropic work to increase the volume of the chamber while storing energy in the flywheel, admitting to said variable-volume chamber, through said second inlet at constant pressure, a quantity of the output vapor of said evaporator and thereby accelerating the increase of the chamber volume to its maximum, utilizing the energy stored in the energy-storing rotary member to compress both said quantities of vapor, together, in a polytropic process by reduction of the volume of said chamber, and discharging said quantities of vapor to the input of said condenser in an isobaric process when the volume of said chamber approaches its minimum, and converting said vapor discharged by said machine to the liquid state in said condenser.

2. A method of refrigeration as defined in claim 1, in which the step of passing a portion of the liquefied refrigerant to said vaporizer includes passing said portion of refrigerant through a pump and thereby pumping said portion of liquefied refrigerant from said condenser to said vaporizer, and in which, further, the step of passing a portion of the liquefied refrigerant from said condenser to said evaporator includes passing said second portion of said refrigerant through an expansion valve.

3. A method of refrigeration as defined in claim 1, in which the variable-volume machine utilized is of the kind having a sealed casing in which is rotatably mounted a rotor having slidable vanes making contact with the walls of the casing and providing a variable-volume chamber between each pair of successive vanes, said rotor being mounted so as to rotate in connection with an energy storing mass constituting said rotary member, and in which method the substeps of operating said variable-volume machine are respectively further defined as follows:

admitting output vapor of said vaporizer through a first intake port through said casing into the space located between a first and a second consecutive vanes of said rotor and permitting said quantity of vapor to expand and cause the rotation of said vanes and said rotor, so that the space between said vanes moves clear of said first intake port, admitting said output vapor of said evaporator into said space between said first and second vanes through a second intake port and permitting both said quantities of vapor to produce further rotation of said vanes and said rotor, so that said space between said vanes moves into the final expansion zone of said machine after having moved clear of said second intake port, utilizing the energy stored in said inertial mass to compress both said quantities of vapor during further rotation of said vanes and said rotor, and discharging said quantities of vapor through an exhaust port through said casing.

4. A method of refrigeration according to claim 1, wherein use is made of a chamber defined by a cylinder and a piston which is capable of moving between a top dead-center and a bottom dead-center, a first mass of vapor is introduced into said cylinder by a first admission means when the piston is located at the top dead-center, said first mass is permitted to expand by closing said first admission means and by allowing the piston to move towards the bottom dead-center, said second mass of vapor is introduced by a second admission means before the piston reaches the bottom dead-center and until the piston reaches said bottom dead-center, said masses are compressed after closure of said admission means by causing the piston to return to the top dead-center, said masses are discharged by an exhaust means before the piston reaches the top dead-center, the exhaust means are closed when the piston has reached the top dead-center.

5. A refrigeration apparatus comprising:

a condenser for liquefying a refrigerant medium having a branched discharge duct connected thereto for leading first and second portions of said liquefied refrigerant respectively to a driving loop nad to a refrigerating loop;

a vaporizer, including a heater and having its refrigerant input and output connected to said driving loop for receiving liquid refrigerant from the driving loop branch of the condenser discharge duct, for converting the refrigerant so received to vapor, and for delivering said vapor at a pressure suitable for powering the apparatus;

a refrigerating evaporator having cooling passages connected in said refrigerating loop for producing refrigeration by the conversion of liquid refrigerant received from said refrigeration loop branch of the condenser discharge duct into vapor, and having a vapor discharge;

a vapor-driven variable-volume machine having a rotatable inertial mass and having a variable-volume chamber with a single outlet port, a first inlet port, and a second inlet port, for storing energy in said inertial mass by expansion of vapor of said refrigerant medium and for compressing said refrigerant vapor by means of energy so stored and delivering said compressed vapor to said condenser, said first inlet port being connected to the output of said vaporizer, said second inlet port being connected to the vapor discharge of said evaporator and said outlet port being connected to said condenser, said ports being openable and closeable in accordance with the cycle of said machine.

6. A refrigeration apparatus as defined in claim 5, in which a pump is interposed between said driving loop branch discharge duct of said condenser and the refrigerant input of said vaporizer for pumping liquid refrigerant from said condenser to said vaporizer, and in which, further, an expansion valve is interposed between said refrigeration loop branch discharge duct of said condenser and the cooling passages of said evaporator.

7. A refrigeration apparatus as defined in claim 5, in which said variable-volume machine comprises a sealed casing within which is rotatably mounted a rotor having an eccentric outer surface of revolution and having slidable vanes making contact with the inner surface of said casing so as to subdivide the space between said rotor and said casing into a plurality of variable-volume chambers, and in which, further, said first inlet port and said second inlet port are spaced from each other circumferentially of said casing so as to admit vapor into the chamber formed between a first and a second vane of said rotor in succession, and in which said outlet port is spaced circumferentially in said casing from said inlet ports and located so that a chamber formed between successive vanes of said rotor discharges through said outlet port as it approaches its minimum volume condition in consequence of the rotation of said eccentric outer surface of said rotor.

8. An apparatus according to claim 5, wherein said variable volume machine is of the type comprising a cylinder and a piston actuated by a connecting-rod and crankshaft linkage, and wherein said variable volume machine comprises:

two admission means for successively introducing between the top and bottom dead-centers of said piston masses of vapor of the fluid delivered by said heat exchanger and by said evaporator, an exhaust means for discharging said masses to the condenser after compression by the piston which has moved back to the top dead-center.

* * * * *